US012264026B2

(12) United States Patent
Rodriguez et al.

(10) Patent No.: US 12,264,026 B2
(45) Date of Patent: Apr. 1, 2025

(54) METHOD AND APPARATUS FOR SEPARATING AND SPOOLING A PAPER WEB

(71) Applicant: Papeltec Overseas, Inc., Atlantic Beach, FL (US)

(72) Inventors: Peter Rodriguez, Jacksonville, FL (US); Jason Rodriguez, Jacksonville, FL (US); Craig Austin, Jacksonville, FL (US)

(73) Assignee: Papeltec Overseas, Inc., Atlantic Beach, FL (US)

( * ) Notice: Subject to any disclaimer, the term of this patent is extended or adjusted under 35 U.S.C. 154(b) by 574 days.

(21) Appl. No.: 17/562,174

(22) Filed: Dec. 27, 2021

(65) Prior Publication Data

US 2022/0204296 A1 Jun. 30, 2022

Related U.S. Application Data

(60) Provisional application No. 63/131,069, filed on Dec. 28, 2020.

(51) Int. Cl.
*B65H 19/28* (2006.01)
*B65H 19/26* (2006.01)

(52) U.S. Cl.
CPC ..... *B65H 19/283* (2013.01); *B65H 19/267* (2013.01); *B65H 19/262* (2013.01); *B65H 2301/41424* (2013.01); *B65H 2301/41427* (2013.01); *B65H 2301/41428* (2013.01)

(58) Field of Classification Search
CPC .... B65H 19/28; B65H 19/283; B65H 19/267; B65H 19/262; B65H 19/286; B65H 75/28; B65H 2301/41424; B65H 2301/41427; B65H 2301/41428; B65H 2301/4176; B65H 2301/41764; B65H 2301/41766
See application file for complete search history.

(56) References Cited

U.S. PATENT DOCUMENTS

| | | | |
|---|---|---|---|
| 2,600,904 | A | 6/1952 | Morgan |
| 2,890,808 | A | 6/1959 | Seror |
| 2,927,710 | A | 3/1960 | Raber |
| 3,542,587 | A | 11/1970 | Aronoff et al. |
| 3,890,191 | A | 6/1975 | Mayer |

(Continued)

FOREIGN PATENT DOCUMENTS

| | | | |
|---|---|---|---|
| DE | 3733841 | A1 | 4/1989 |
| DE | 29501739 | U1 | 3/1995 |

(Continued)

*Primary Examiner* — Michael R Mansen
*Assistant Examiner* — Raveen J Dias
(74) *Attorney, Agent, or Firm* — Joseph P. Kincart; Tracnik Law PLLC

(57) ABSTRACT

An apparatus for dispensing an adhesive with paper covers to be used in a paper web turn-up operation. The resulting adhesive and paper cover construct is used in effecting the attachment of a paper web to an approaching spool. In some examples, the paper cover of the deposited adhesive may be affixed on two sides surrounding the deposited adhesive, in other examples a single attachment may be used. In some examples, the paper cover may be perforated to facilitate rupture of the paper and flow of adhesive. In some examples, perforations may enable the movement of adhesive through the paper.

16 Claims, 8 Drawing Sheets

(56) References Cited

U.S. PATENT DOCUMENTS 4,338,147 A * 7/1982 Backstrom ..... B65H 75/28 242/532.3
4,385,960 A * 5/1983 Zodrow ..... B65C 9/2269 156/578
4,723,724 A * 2/1988 Bradley ..... B65H 19/2269 242/532.3
4,726,533 A * 2/1988 Dropczynski ..... B65H 19/305 242/532.3
5,009,736 A * 4/1991 Lehto ..... B65H 19/283 156/522
5,040,738 A * 8/1991 Biagiotti ..... B65H 19/283 242/532.3
5,046,675 A 9/1991 Rodriguez
5,299,407 A 4/1994 Schuttler et al.
5,319,833 A * 6/1994 Kohl ..... B21F 33/002 72/134
5,417,383 A 5/1995 Rodriguez et al.
5,453,141 A 9/1995 Rodriguez
5,601,243 A * 2/1997 Inagaki ..... B65H 19/28 242/582
5,637,170 A * 6/1997 Rodriguez ..... B65H 19/267 156/187
5,735,481 A * 4/1998 Loosen ..... B65H 19/2223 242/532.3
5,851,348 A 12/1998 Muenzer et al.
6,045,085 A * 4/2000 Andersson ..... B65H 37/02 242/532.3
6,253,818 B1 * 7/2001 Preinknoll ..... B65H 19/283 156/578
6,467,719 B1 * 10/2002 Rodriguez ..... B65H 19/267 242/532.3
6,578,788 B2 6/2003 Rodriguez et al.
6,805,317 B1 * 10/2004 Andersson ..... B65H 19/283 156/578
7,100,657 B2 * 9/2006 Kataoka ..... B65H 18/106 156/565
7,290,732 B2 11/2007 Wilmoth et al.
7,469,856 B1 * 12/2008 Tsai ..... B65H 19/283 242/532.3
7,875,152 B2 1/2011 Rodriguez
8,124,209 B2 2/2012 Rodriguez
9,539,797 B2 1/2017 Heinemann
10,815,092 B2 10/2020 Rodriguez et al.
2002/0134879 A1 * 9/2002 Rodriguuez ..... B65H 19/28 242/532.3
2003/0113499 A1 6/2003 Sieber et al.
2004/0046080 A1 * 3/2004 Enwald ..... B65H 19/262 242/526
2004/0256513 A1 * 12/2004 Perini ..... B65H 19/283 242/532.3
2005/0133654 A1 6/2005 Metzger
2005/0155714 A1 * 7/2005 Adams ..... B65H 19/10 242/555.3
2005/0194489 A1 * 9/2005 Rodriguez ..... B65H 19/283 242/532.3
2005/0258298 A1 * 11/2005 Maddaleni ..... B65H 19/29 242/526
2006/0076452 A1 * 4/2006 Mainous ..... B65H 19/28 156/578
2006/0180700 A1 8/2006 Wambaugh et al.
2006/0266871 A1 * 11/2006 Haven ..... B65H 19/28 242/532.3
2007/0023562 A1 * 2/2007 Perini ..... B65H 19/283 242/532.3
2008/0061183 A1 * 3/2008 Rodriguez ..... B65H 19/283 242/521
2008/0111017 A1 * 5/2008 Gambini ..... B65H 19/2269 242/534
2008/0113142 A1 * 5/2008 Rodriguez ..... B65H 19/283 428/40.1
2008/0149757 A1 * 6/2008 Tiitta ..... B65H 19/28 428/40.1
2008/0245923 A1 * 10/2008 Maddaleni ..... B65H 19/286 242/610.1
2008/0271869 A1 * 11/2008 Tsai ..... B65H 19/2269 162/283
2009/0302146 A1 * 12/2009 Morelli ..... B65H 19/267 242/526
2010/0104792 A1 * 4/2010 Rodriguez ..... B65H 19/102 428/40.1
2010/0163665 A1 * 7/2010 Gambini ..... B65H 19/267 242/521
2010/0163666 A1 * 7/2010 Gambini ..... B65H 19/2269 242/521
2010/0237179 A1 * 9/2010 De Matteis ..... B65H 19/286 242/526
2011/0133015 A1 * 6/2011 Gelli ..... B65H 19/2269 242/521
2012/0318906 A1 * 12/2012 Gambini ..... B65H 19/267 242/526
2013/0099924 A1 * 4/2013 Larsson ..... G08B 21/182 428/411.1
2013/0221150 A1 * 8/2013 Morelli ..... B65H 19/267 242/522
2015/0368517 A1 12/2015 Yasuzawa
2016/0075530 A1 * 3/2016 Morelli ..... B65H 18/20 242/521
2017/0137249 A1 * 5/2017 Perini ..... B65H 19/283
2017/0341894 A1 11/2017 Muller
2018/0099835 A1 * 4/2018 Couchey ..... B65H 19/28
2018/0257891 A1 * 9/2018 Sehlleier ..... B65H 75/10
2018/0312368 A1 11/2018 Harris et al.
2018/0339828 A1 11/2018 Lin
2020/0148494 A1 * 5/2020 Malmqvist ..... B65H 19/265

FOREIGN PATENT DOCUMENTS

DE 102006018499 A1 8/2007
WO 2007041599 A1 4/2007

* cited by examiner

METHOD AND APPARATUS FOR SEPARATING AND SPOOLING A PAPER WEB

CROSS REFERENCE TO RELATED APPLICATIONS

The present application claims the benefit of Provisional Patent Application Ser. No. 63/131,069 filed Dec. 28, 2020; the entire contents of which are hereby incorporated by reference.

BACKGROUND OF THE INVENTION

Modern paper manufacturing is typically performed by producing continuous lengths of paper having widths of over 400 inches in some cases, referred to as paper webs, which are wound onto web spools for subsequent converting, storage, transfer or the like. The winding or spooling operation for the paper web, such as in the case of tissue grades, occurs at high speeds, in some cases exceeding 6000 feet per minute, and in order to maximize production by minimizing downtime and waste it is desirable to sever and simultaneously transfer the moving paper web from a full spool onto an empty spool without stopping, adjusting draws (i.e. the speed differential between the incoming and outgoing web rotating support members that are not driven by a common source) or slowing the movement of the web. Methods and apparatuses for accomplishing this severing and transfer utilizing what is known as a transfer or turn-up tape have long been known. An early example of such a system is shown in U.S. Pat. No. 2,461,246 to Weyenberg, issued in 1949. Other examples are shown in our U.S. Pat. Nos. 4,659,029, 4,757,950, 4,783,018, 5,046,675, 5,453,141, 5,637,170, and 5,954,290. Further examples and detailed discussion of such equipment, systems and methodologies are present in our U.S. Pat. Nos. 4,659,029, 4,757,950, 4,783,018, 5,046,675, 5,417,383, 5,453,141, 5,637,170, 5,954,290, 6,467,719, 6,578,788, 7,875,152, 8,124,209, 8,178,181 and 8,580,062, the disclosures of which are incorporated herein by reference.

The high-speed transfer of lightweight paper webs, such as groundwood papers (including, for example, newsprint) or tissue paper, is more difficult to accomplish due to the weaker structure of the paper. In addition, in systems using adhesive transfer tapes for the web transfer, the exposed adhesive side of the transfer tape is often contaminated with airborne dust, floating paper fibers and other debris, which are prevalent with the lightweight paper webs, such that the adhesion is weakened or even substantially blinded, which can result in a failed transfer. A failed transfer results in lost production, inconsistent winding of the product and inconsistent roll sizes, excessive waste, shorter service life of the fiber cores which are commonly used in tissue making machines, and unsafe operating conditions.

Where liquid adhesive is dispensed directly onto the spinning spool, as by a hand-held pump-fed nozzle projecting a stream, the adhesive is frequently thrown off the spool by centrifugal force, especially where it has not picked up the paper web immediately. Applying a liquid adhesive in this manner is not entirely predictable nor efficient and causes a fouling accumulation of adhesive on adjacent machinery. Efforts have been made to eliminate the shortcomings of liquid adhesive systems. Some employ fixed nozzles spaced across the width of the paper web. These nozzles can deliver a precisely controlled amount of adhesive, eliminating overuse and fouling of equipment, but must be provided with a means to catch occasional drops of adhesive that randomly fall from the nozzles and onto the web.

It is an object of this invention to provide an improved method of utilizing a liquid adhesive to sever and transfer a continuous paper web from one spool to another spool, such as may be especially useful in transferring lightweight papers such as tissue or newsprint.

SUMMARY OF THE INVENTION

Accordingly, it is an object of this invention to provide an apparatus and method addressing the contamination problem of the exposed adhesive on the transfer tape. It is a further object to provide such an apparatus and method that allows for the transfer tape to be dispensed in the desired length as needed for performing the turn-up operation. It is a further object to provide an apparatus and method adapted for use in many different industrial applications.

Therefore, the present invention relates generally in a first sense to the field of devices, apparatuses and methods of effecting the high-speed severing and transfer of a rapidly advancing paper web from a rotating full spool onto an empty spool, and more particularly where such an operation is performed on a light density or tissue paper web. More particularly, the invention relates to methods using a dispensed adhesive bead of appropriate characteristics set between adhesive strips which hold a piece of tissue paper above the adhesive bead and the use of this structure in a paper web severing/transfer method. In some examples the tissue paper may be repulpable to allow for recycling of waste materials. The tissue paper or other lightweight paper used in its place may have characteristics of sufficient strength, thickness, texture and stiffness to accomplish the turn-up transfer operation without breaking or separating throughout its subsequent use. The adhesive of the turn up construct may be squeezed to and through the tissue paper as the spool to which it has been applied advances towards the nip and the reel drum. The adhesive saturated tissue paper acts as an improved turnup transfer mechanism. The adherence of the paper web to the adhesive saturated tissue paper may become the affecting means for severing, transferring and securing the light density or tissue paper web from a rotating full web spool onto an empty web spool.

A dispensing apparatus may be used to deposit a bead of adhesive upon a new spool as well as a covering of tissue paper which is also adhered to the new spool with contact adhesive. In some examples, the tissue paper may be preassembled with pressure sensitive adhesive (PSA) strips on its edge and release coating strips on the opposite side of the paper so that it may be stored and delivered from a spooled state. The pressure sensitive adhesive may be coated, layered or laminated to the paper. The dispensing apparatus may comprise a dispensing system for dispensing the adhesive bead as well as a paper dispensing system that can press the pressure sensitive adhesive on the tissue paper to the new spool.

One general aspect includes a device for paper web turn-up. The device also includes a dispensed liquid adhesive bead deposited upon a paper spool; a paper cover, where the paper cover is positioned to cover the dispensed liquid adhesive bead. The dispensed liquid adhesive bead may be caused to flow to a surface of the paper cover when the dispensed liquid adhesive bead rotates upon the paper spool into a nip of the paper spool and a reel drum. In an example, the liquid adhesive upon the surface of the saturated paper cover attaches an advancing paper web pulling it to the paper spool and severing the paper web to complete the paper web turn-up. Implementations may include the device where the paper cover may include a paper with small pores, or perforations where the paper cover ruptures when the dispensed liquid adhesive bead is pressurized within the nip.

One general aspect includes an apparatus for preparing a liquid adhesive construct for paper web turn-up. The apparatus also may include a vessel which contains a liquid adhesive; a dispensing nozzle, where the dispensing nozzle defines a height and width of a bead of the liquid adhesive as it is applied to a paper spool; a pump, where the pump moves the liquid adhesive through a tube to the dispensing nozzle; a control to allow a user to activate the dispensing of the liquid adhesive; and a paper tape spool, where the paper tape spool stores a paper tape cover; and at least a first press pad to apply pressure to a pressure sensitive adhesive upon the paper tape cover, where applying pressure to the pressure sensitive adhesive attaches the paper tape cover to the paper spool as a cover to a dispensed liquid adhesive bead.

Implementations may include one or more of the following features. The apparatus for preparing a liquid adhesive construct for paper web turn-up may include controls and electronics to deposit the liquid adhesive in a pattern. In some examples, the operation may be automated. In other examples, a handle and trigger may be operated by a user to control deposition in a handheld manner. The pattern may include a chevron. The apparatus is configured to deposit the liquid adhesive on the surface of a paper spool at an angle relative to a long axis of the paper spool. In some examples, a hand-held apparatus may apply a system of paper and adhesive to the spool as the operator desires by positioning the apparatus at any angle before starting along the spool. The angle may not exceed that of a spiral of one revolution over the length of the spool—which in some examples may approximate 15 degrees from the long axis. Said exemplary angle may reduce the thumping that may occur if the entire length of the adhesive and paper system passed through the nip at once while accomplishing the turnup rapidly enough to only accumulate one layer of paper at any given point. In some examples such application may prevent a cone-shaped accumulation to form, said accumulation which may contribute to greater tension on one side by virtue of the greater circumference, which in turn may create wrinkles.

One general aspect includes a paper web turn-up apparatus. The paper web turn-up apparatus also includes a paper spool with a spool surface to attach the paper web. The apparatus also includes a liquid adhesive bead dispenser positioned to deposit a liquid adhesive bead across the spool surface. The apparatus includes a paper cover positioned to cover the dispensed liquid adhesive bead and attach an advancing paper web and pull the advancing paper web to the paper spool and sever the advancing paper web to complete a paper web turn-up, and wherein the dispensed liquid adhesive bead flows to a surface of the paper cover when the dispensed liquid adhesive bead rotates upon the paper spool into a nip of the paper spool and a reel drum.

Implementations may include one or more of the following features. The apparatus where the paper cover may include a paper with small perforations, and where the paper cover ruptures when the liquid adhesive bead is pressurized within the nip. In some examples, the liquid adhesive is deposited at an angle relative to a rotary axis of the paper spool.

One general aspect includes a method of performing a paper web turn-up. The method includes dispensing a liquid adhesive bead upon a paper spool; covering the liquid adhesive bead with a paper cover; wherein the paper cover is attached to a surface of a new spool. The method includes rotating the new paper spool to press the liquid adhesive bead and attached paper cover between the paper spool and a reel drum in a nip of the paper spool and the reel drum. The method includes flowing the liquid adhesive bead to a surface of the paper cover and pressing the liquid adhesive bead and attached paper cover between the paper spool and the reel drum, with the liquid adhesive upon the surface of the paper cover. The method includes attaching an advancing paper web to the paper spool and severing the paper web to complete the paper web turn-up.

One general aspect includes an apparatus for preparing a liquid adhesive construct for paper web turn-up. The apparatus includes a vessel that contains a liquid adhesive; a dispensing nozzle, where the dispensing nozzle defines a height and width of a bead of the liquid adhesive as it is applied to a paper spool. The apparatus also may include a pump, where the pump moves the liquid adhesive through a tube to the dispensing nozzle. The apparatus may also include a control to allow a user to activate a dispensing of the liquid adhesive; a paper tape spool, where the paper tape spool stores a paper tape cover. The apparatus may also include a first press pad to apply pressure to a pressure sensitive adhesive upon the paper tape cover, wherein applying pressure to the pressure sensitive adhesive attaches the paper tape cover to the paper spool as a cover to a dispensed liquid adhesive bead.

DETAILED DESCRIPTION OF THE INVENTION

With reference to the drawings, which are provided for descriptive and illustrative purposes which are not meant to be limiting as the scope of the invention, the invention in various embodiments in a broad and general sense is an apparatus and a method for dispensing an adhesive deposit along with a lightweight paper or tissue paper covering which may be used in a paper web turn-up operation. The process may facilitate the turn up operation wherein a continuous paper web being rolled onto a first web spool is severed and transferred to an empty second web spool when the first web spool is fully wound. In the operation, the transfer may occur without requiring the flow of the paper web to be temporarily altered or stopped. It is to be understood that disclosure of the apparatus and method in relation to a paper web turn-up operation is an exemplary disclosure not meant to be limiting, as the adhesive deposit structure and associated dispenser structures may be suitable for use in different industrial applications.

It is an object of this invention to provide an improved method of utilizing a liquid adhesive to sever and transfer a continuous paper web from one spool to another spool, such as may be especially useful in transferring lightweight papers such as tissue or newsprint, wherein the use of a liquid adhesive is improved by increasing its viscosity so a standing bead may be placed directly on the empty spool. The liquid adhesive standing bead may be applied with a significant height, whereby the height of the bead above the surface of the empty spool assists in closing the nip between it and the reel drum.

In some examples, the methods may provide the bead of viscous adhesive with a cover adhered to the empty spool along the length of the bead to protect it from airborne paper fibers, dust and other debris. It may be desirable to secure the cover with pressure-sensitive adhesive tape some distance to either side of the bead.

In some examples, the methods may provide that the cover is made of a porous tissue paper whose pores are small enough to prevent the viscous adhesive from permeating the tissue while the spool is spinning above the paper web, but whose pores permit the adhesive to be discharged from the face of the tissue when the empty spool is brought into contact with the paper web on the reel drum and compresses the adhesive bead, such that the adhesion between the paper web and the viscous adhesive is sufficient to pull the paper web around the empty spool, bursting the paper web in tension to cause a turn-up.

Figures 1, 1A:
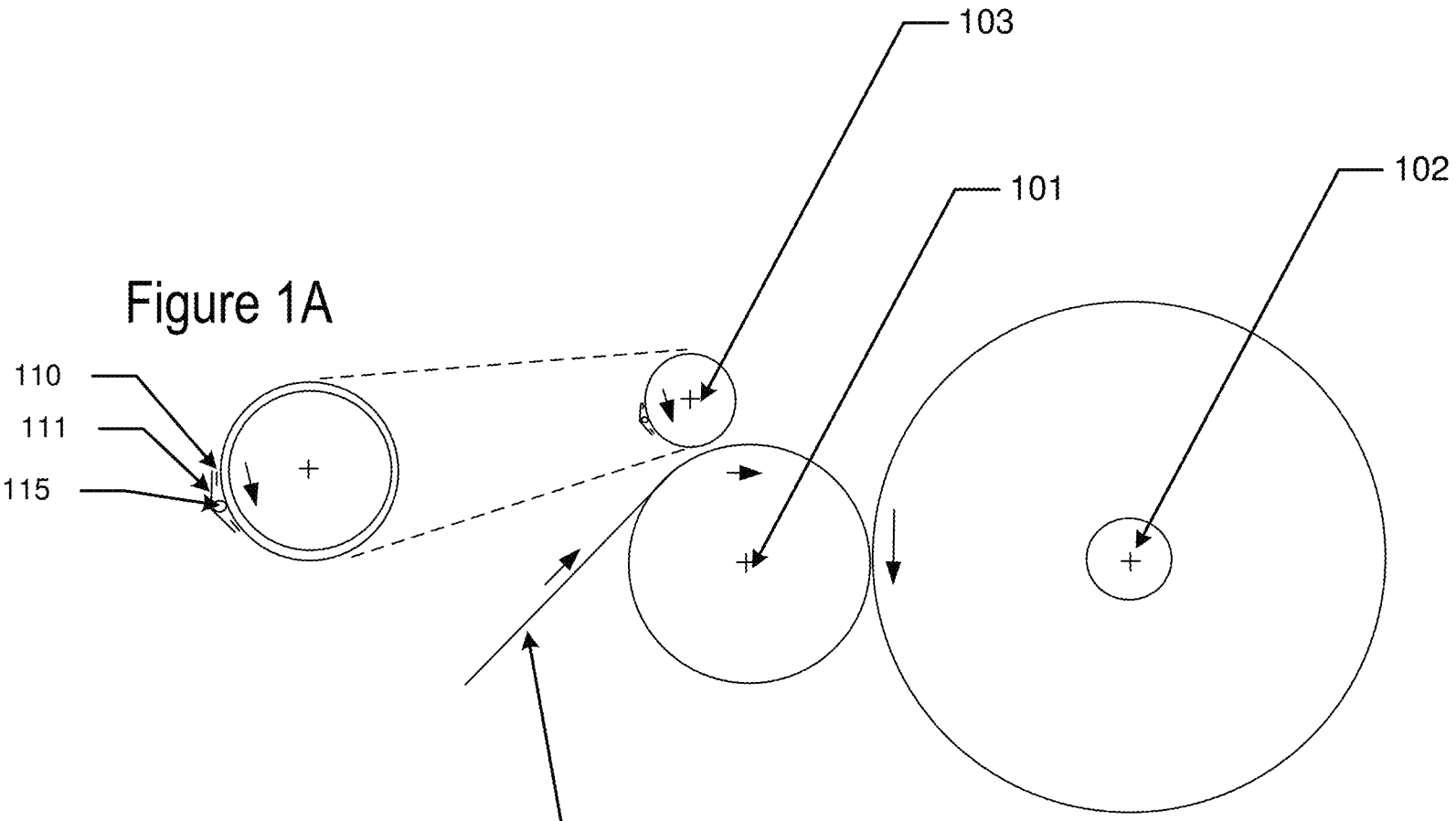
FIG. 1 is an illustration of a paper processing system where a new spool has been set up for paper web transfer.
FIG. 1A is an enlarged view of an exemplary adhesive bead and paper construct for turn up.

Referring to FIG. 1, a starting step of a paper turn up process utilizing the concepts of the present specification is illustrated. In the first (starting) step an operator has prepared the adhesive and tissue paper turn up construct on a new spool 103. The new spool 103 will be used to take up the new paper web 100 as it is moved by the reel drum 101 in the direction as shown by the arrows. At the starting step the old spool 102 is approaching its capacity to take up the paper web 100. In the inset figure, FIG. 1A an enlarged view of the new spool 103 is illustrated. on the surface of the new spool is the adhesive bead 115 covered by a tissue paper covering 111 which is held to the new spool 103 with pressure sensitive adhesive strips 110.

Figures 2, 2A:
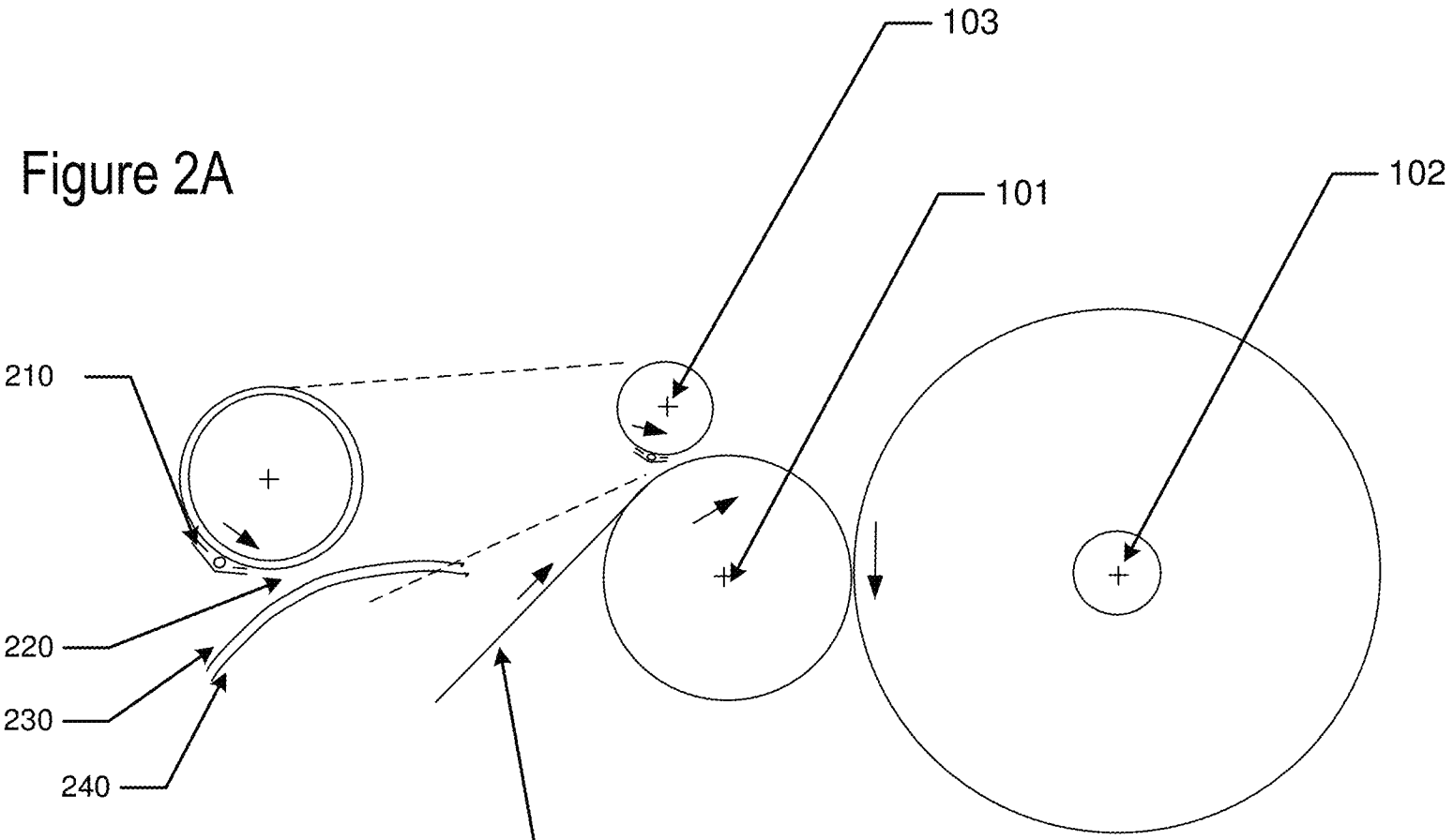
FIG. 2 is an illustration of a paper processing system where the adhesive and paper configuration is approaching the nip.
FIG. 2A is an enlarged view of an exemplary adhesive bead and paper construct as it approaches the nip.

Referring now to FIG. 2, the new spool 103 approaches the nip as it moves towards the reel drum 101. The paper web 100, is still wrapping to the old spool 102. As displayed in FIG. 2A, the deposited adhesive bead and tissue paper structure 210 sits on the surface of the new spool 103. As the new spool approaches the nip 220 it will contact the paper web 230 which is upon the reel drum surface 240 and be rotated as shown by the arrows. Rotation may be accomplished, for example, via an electric or air powered motor (not illustrated). In some examples, the motor described may bring the new spool up to speed prior to it approaching the spool and closing the nip. The rotary speed (rotations per minute) of the empty spool may be such that its surface speed equals that of the paper web and reel drum surface.

The rotation may create a centrifugal force that may tend to throw or expel the adhesive bead off the spool face. Such an effect may be a motivation and primary function of the light paper cover which holds the bead in place.

The rotation will bring the deposited adhesive bead and tissue paper structure 210 into the nip which will put pressure onto the adhesive bead. In some examples, the tissue paper provides a cover made of a porous tissue paper whose pores are small enough to prevent the viscous adhesive from permeating the tissue while the spool is spinning above the paper web, but whose pores permit the adhesive to be discharged from the face of the tissue when the empty spool is brought into contact with the paper web on the reel drum and compresses the adhesive bead.

In some examples, the adhesion between the paper web and the viscous adhesive is sufficient to pull the paper web around the empty spool, bursting the paper web in tension to cause a turn-up.

Figures 3, 3A:
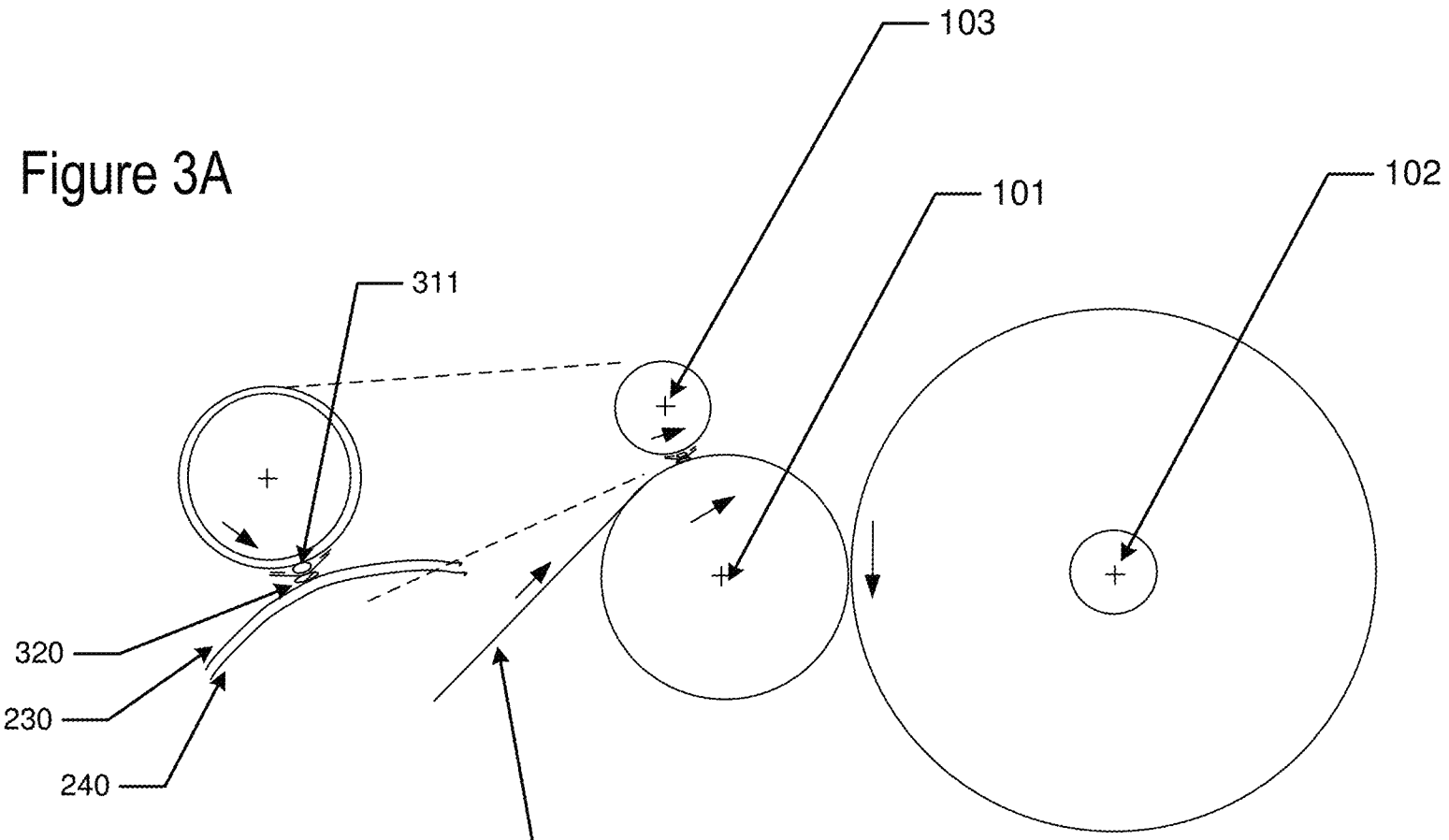
FIG. 3 is an illustration of a paper processing system where the adhesive and paper configuration are compressed between the new spool and the reel drum.
FIG. 3A is an enlarged view of an exemplary adhesive bead and paper construct as it is compressed to release adhesive through the tissue paper.

In an example, proceeding now to FIGS. 3 and 3A, when the adhesive bead and paper web structure is in the nip, the adhesive bead 311 may be pressed to flow through the tissue paper in the nip 320. The interaction of the adhesive impregnated paper with the paper web 230 will begin to form an adhesion between the adhesive on the new spool and the paper web 100. It may be noted that the proportions of the components in the figures may be exaggerated for the thickness or relative size to the spool and are illustrated for purposes of clarity. In some examples, the entire construct illustrated may be in reality sized to just a few thousandths of an inch in the nip. The enlarged illustration in FIG. 3A does not show the degree to which the adhesive and paper construct may be flattened as it proceeds through the nip.

Figures 4, 4A:
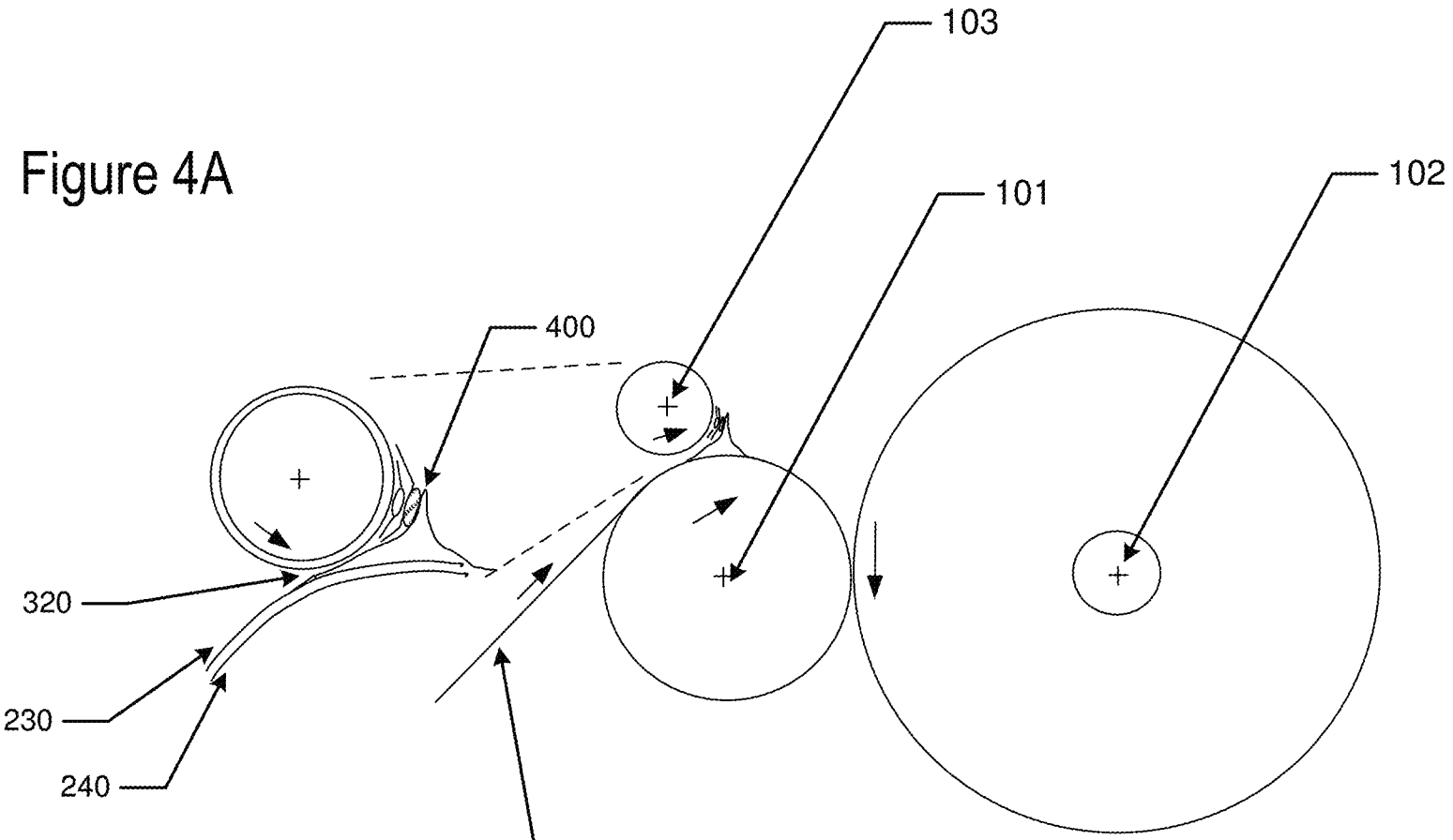
FIG. 4 is an illustration of a paper processing system where the adhesive saturated tissue paper grabs the advancing paper web.
FIG. 4A is an exploded view of an exemplary adhesive saturated paper construct as it grabs the advancing paper web.

Proceeding now to both FIGS. 4 and 4A, the adhesion of the paper web 400 as the reel drum 101 rotates and lifts the paper toward the new spool 103. The adhesive location is rotating out of the nip 320 as new paper from the paper web 230 advances on the reel drum surface 240. As discussed, the illustrations are exemplary and are provided to illustrate fundamental aspects of various embodiments. The scales of the illustrations are not intended to be limiting, such as for example, the relative dimensions of an adhesive bead when compared to paper thickness and spool dimensions.

Figures 5, 5A:
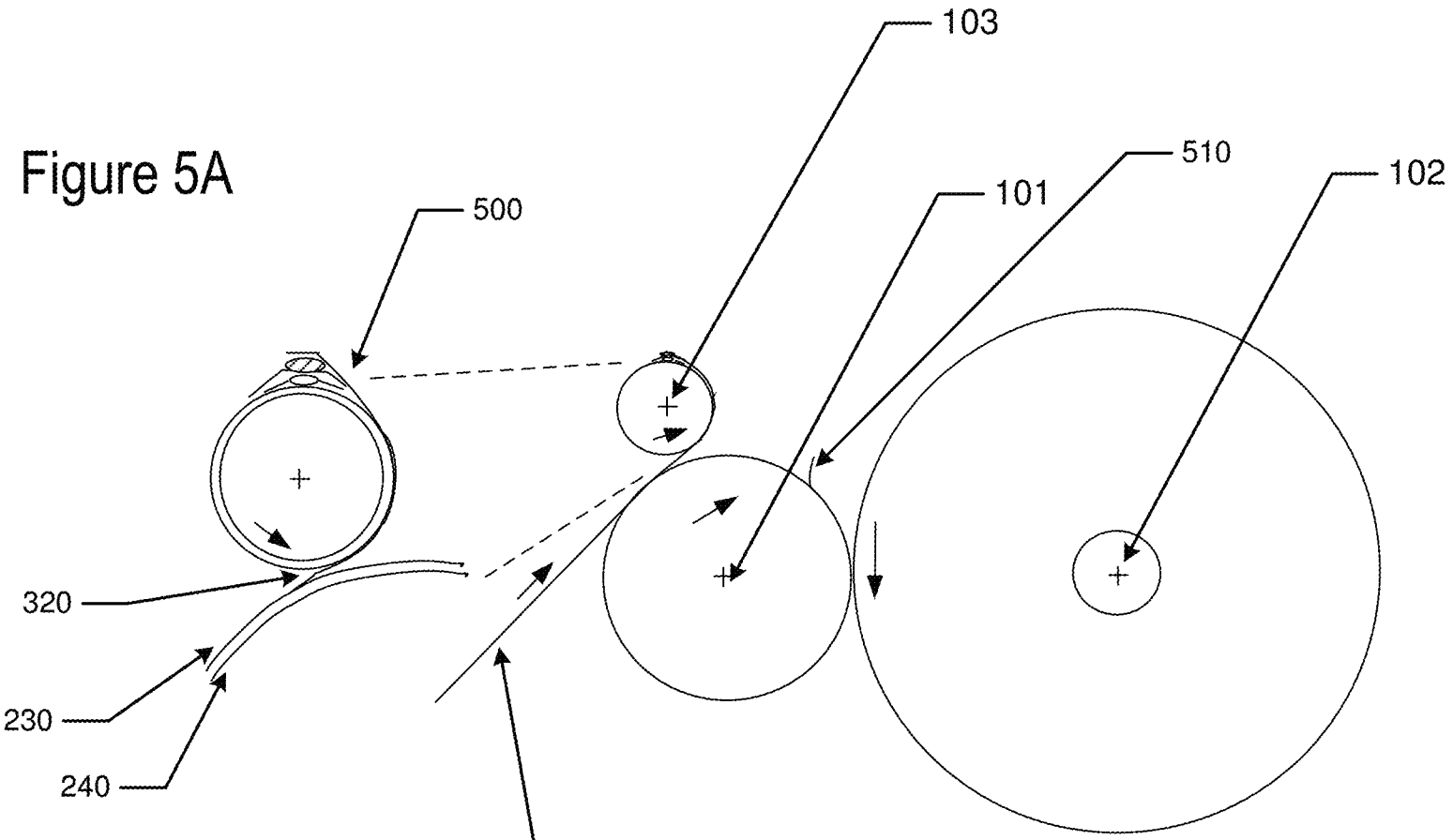
FIG. 5 is an illustration of a paper processing system where turn up has occurred.
FIG. 5A is an exploded view of an exemplary paper processing system where turn up has occurred.

As illustrated in FIGS. 5 and 5A, as the new spool continues to advance with the paper web attached to the adhesive it may eventually tear or burst the paper web 500 away from the last portion 510 of the paper web that is rolling onto the old spool. This completes the turnup process. The old spool 102 may be moved out of the region of the reel drum 101. As the old spool 102 is moved out of the region the new spool may continue to pick up paper from the paper web 100 and be moved into the location that the old spool had occupied before it was moved.

In a non-limiting example, the bead of a viscous adhesive may be applied with a dimension between about 3 mm (⅛ inch) and 6 mm (¼ inch) in height and width, applied to the spool face. The covering may be an approximately 50 mm (2 inch) wide ribbon of permeable tissue paper fixed in place, centered and longitudinally oriented, over the bead by thin adhesive ribbons at both edges of the tissue paper. The tissue paper ribbon may be peaked over the bead of adhesive by lightly contacting it when applied. The process of placing the paper may generally preserve the height and width of the bead, while being pressed tightly against the thin adhesive ribbons that adhere it to the spool face.

Figure 6:
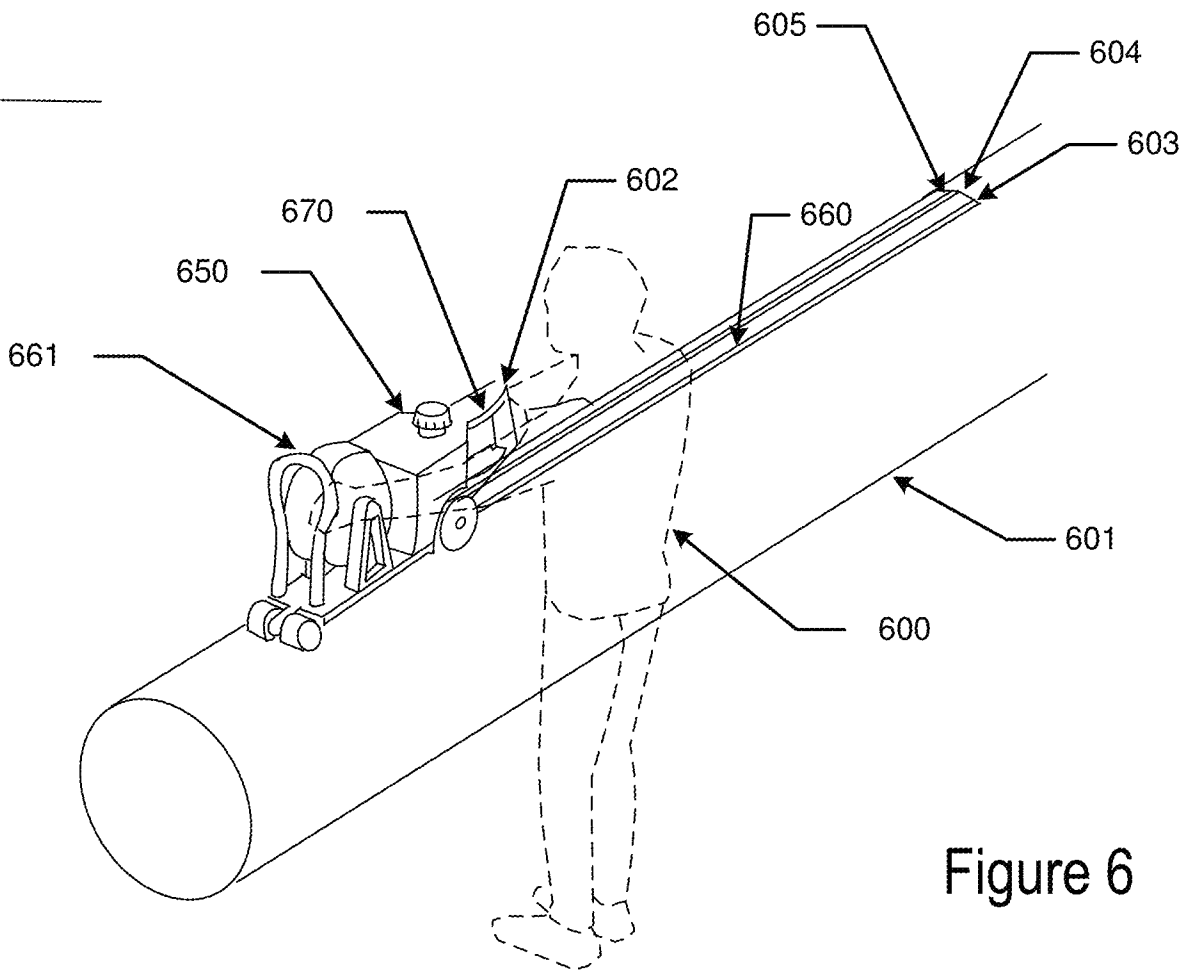
FIGS. 6 and 6A illustrate an exemplary application of adhesive and tissue paper elements of a paper processing system.
Figure 6A:
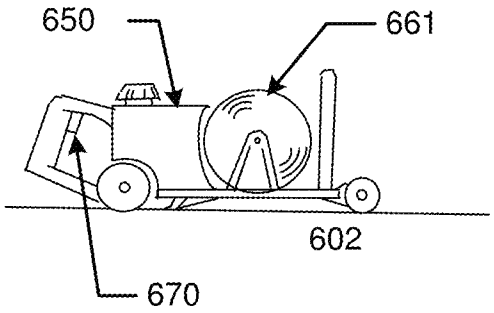

Referring to FIGS. 6 and 6A, an illustration and an enlarged view of an apparatus to support an operator in the placement of the adhesive bead and tissue paper cover is provided. An operator 600 may engage a new spool 601 with an apparatus 602 to apply the adhesive and paper structure as described herein. In some examples, a hand-held applicator may be employed. The application may be a fixed device or a movable device amongst other possibilities. The choice between configurations may be influenced by the size of the spool, frequency of its use and other such aspects of the application. A completely automatic system not requiring operator intervention may also be possible.

In some examples, an adhesive reservoir 650 may flow adhesive through a nozzle at a prescribed distance from the new spool 601 at a constant rate to create a deposited bead of adhesive 604 upon the new spool 601. Meanwhile, a tissue paper construct 660, which may be stored on a paper tape spool 661 may be affixed to the new spool 601. In the illustrated example, both sides of the tissue paper cover may be affixed to the new spool on a first pressure sensitive adhesive location 603 and a second pressure sensitive adhesive location 605 on either side of the deposited bead of adhesive 604. The operator 600 may engage a control 670 which may activate a pump to pump the adhesive from the adhesive reservoir 650 as well as activating press pads on the apparatus to create pressure on the pressure sensitive adhesive to attach the paper cover to the new spool 601. In some examples, the apparatus may include controls and electronics to allow for patterns to be formed in the deposition of the liquid adhesive. As will be described in following sections there may be numerous variations in the manner of depositing the bead of adhesive 604 and in the nature of the paper cover. The adhesive formulation may be modified with fillers and/or solvents to achieve a desired set of properties including its viscosity, its set time, and its general adhesion properties to operate in the manners described.

In some examples, the tissue paper construct may be preformed and placed on a spool. The preforming may involve a number of different processes. In a basic sense the paper may be cut into a band of the appropriate dimension such as around 2 inches wide. That paper band may have a creasing operation to emboss or crease the paper. The middle of the strip may be creased in such a manner in some examples. The paper may also have cuts made at various places, such as in the middle in a dashed pattern, or in two patterns that are each generally a line with dashed aspects. Additional examples are discussed in later sections. The paper may have holes cut into it or stamped into it. In some examples, needles or other implements may penetrate portions of the paper to create pores of defined characteristics in defined regions of the paper tape. Double sided strips of pressure sensitive contact adhesive may be applied to one or both of the edges of the paper tape to define a contact adhesive that may be applied to a new spool as has been discussed. The contact adhesive may be selected from various selections with different properties which may include adhesion, tackiness, color, or thickness, among others.

In some examples, the distal side of the paper tape from the contact adhesive strips may be treated with chemicals, such as silicones, to impart a release characteristic to them or other means may be employed to make the back of the paper tape resistant to adhering to contact adhesive strips when the treated paper tape is rolled upon a spool. A spooled paper tape thus treated may be applied by an apparatus while it dispenses adhesive beads by being pressed upon the pressure sensitive adhesive portions to the surface of the new spool. These different properties may include adhesion, tackiness, color, or thickness, among others.

Figures 6B, 6C, 6D:
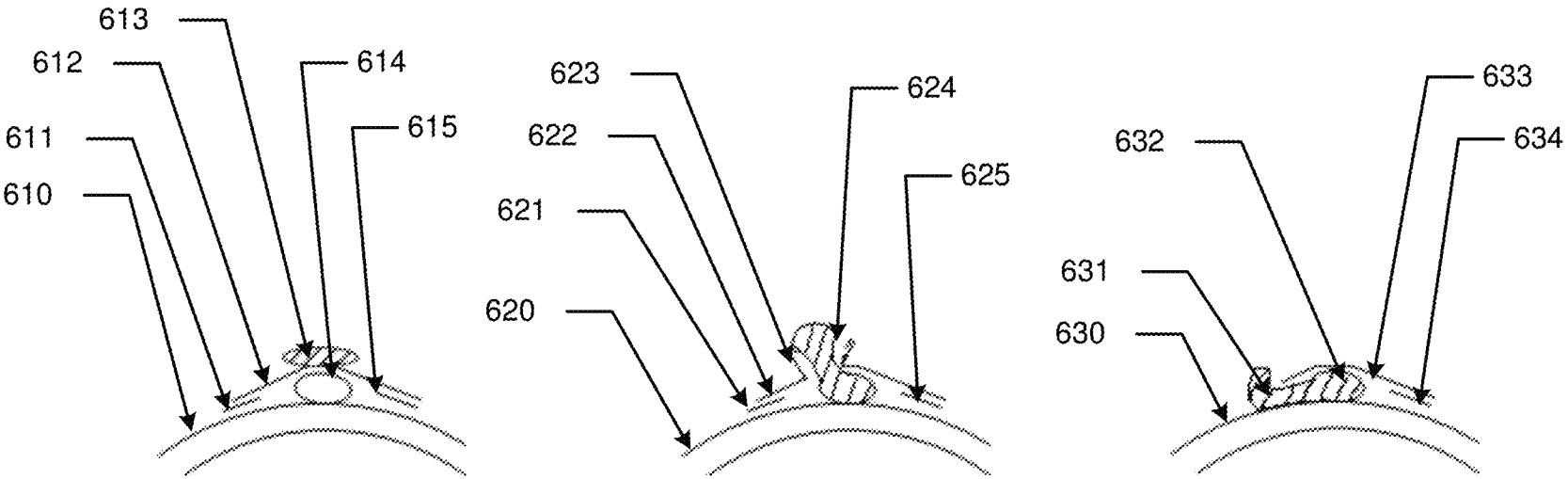
FIGS. 6B-6D illustrate different examples of adhesive release.

Referring to FIGS. 6B, 6C and 6D, examples of different types of paper cover and deposited bead of adhesive embodiments are illustrated. As mentioned in the previous example of FIG. 6, in some examples a tissue paper or lightweight paper cover 612 may be adhered to a surface of a new spool 610 with contact adhesive strips 611, 615 such that the strip sits just above an applied adhesive bead 614. As the pressure from the nip squeezes the paper cover and deposited bead construct, in examples where the paper has pores naturally or formed, the adhesive 613 may diffuse through the pores and onto the other surface of the paper. This adhesive on the top surface may then grab the paper web as it passes by (either as the initial diffusion occurs or in later rotations). In some examples where slots or holes are cut into the paper tape, the adhesive may flow through these regions preferably. In these examples, the paper tape may cover all or most of the adhesive bead so that it does not become covered with any particles in the environment of the paper processing equipment. In the case of holes in the paper, the portion of adhesive beneath the holes may become covered with particles from the environment, but the diffusion of adhesive when pressurized may again cover the region with new adhesive material.

In some examples, a lightweight paper without inherent or formed pores may be used. Referring to FIG. 6C, the activation of this type of embodiment is illustrated. In these examples, rather than the adhesive pressing through pores in the paper cover, it may be squeezed to the trailing side of the tent-like paper shape and then burst the tissue. In some examples, violent bursting of the tissue may generate a larger surface area of the liberated adhesive which may, therefore, enhance the bond made between the web and the spool more with some grades of paper. As illustrated, a surface of a new spool 620 may be covered with an adhesive bead with a paper covering 622, where the paper is relatively non-porous. The paper may be held on both sides 621 and 625 with the contact adhesive. The paper when squeezed with enough pressure may rupture 623 allowing adhesive to burst forth 624 from the protected bead.

In another example, a covering paper may be adhered on just one side. Referring to FIG. 6D, a single side 634 of the paper tape 633 may be held with adhesive to the surface 630 of the new spool. In general, the one side may be more effective if it is the leading edge of the paper tape as it turns in the paper processing system. In this manner, aerodynamic forces may keep the paper in a position covering the bead until the adhesive is released. Alternatively, in some examples where the spools are rotating at high rates, the centrifugal forces acting on the paper may actually cause a paper ribbon to be thrown away from the surface sufficiently to resist aerodynamic forces. In some examples, a cover held in place only at its leading edge may actually permit the adhesive to migrate along the underside of the cover and away from the spool face and may result in the adhesive being thrown off in drops or streamers.

Accordingly, a paper ribbon being held on a single side may function better on slow machines. The adhesive bead 632 may be squeezed and push the adhesive material around 631 the paper tape as the paper and adhesive construct approaches the nip. As may be apparent a combination of different configurations may act in similar manners to these examples, such as in a non-limiting sense, an example where the paper tape is scored on one of its sides so that it ruptures along the side in a defined way rather than rupturing at a relatively random location.

Referring now to FIGS. 7A-7F, different configurations of the deposited adhesive and paper tape construct may be set up upon the new spool. Although the patterns of deposited adhesive are described as shapes, each shape is not limited to a strict geometric property. For example, a linear shape, or "line" may include a wave effect of angular deviation as it progresses from end to end of the line. However, a described line will progress in a generally linear fashion from a first end point to a second end point.

Figure 7A:
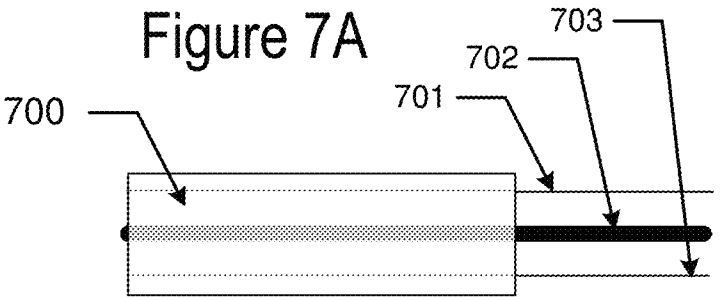
FIGS. 7A-7F illustrate examples of adhesive and lightweight paper application.

Referring to FIG. 7A, the standard configuration as has been discussed in many examples is illustrated from a top down perspective. The paper tape 700 is held on two sides above a deposited adhesive bead 702. The paper is illustrated with a portion not covering the adhesive deposit and the pressure sensitive adhesive strips 701, 703 for illustration purposes only, in many examples these regions may be covered with the paper as well. In one alternative for application, the pressure sensitive adhesive strips 701, 703 may be applied to the spool separately from the paper tape. In the other alternative as previously discussed they may be placed upon paper tape which may be spooled. The bead and ribbon may also be applied discontinuously to conserve its components or to correspond with multiple slit widths of the paper web to accommodate downstream rewinding or converting operations.

Figure 7B:
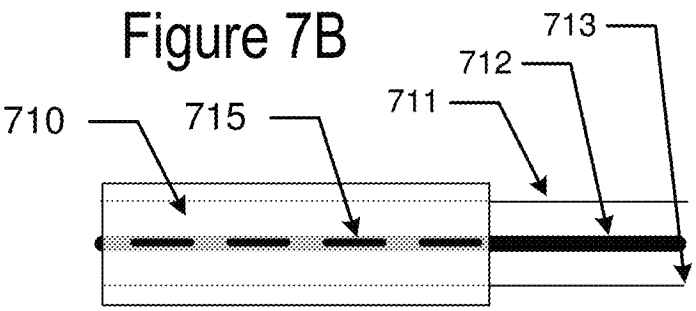

Referring now to FIG. 7B, an example is illustrated with a paper tape 710 and adhesive strips 711 and 713 surrounding the deposited adhesive 712. In this example, a cut dashed generally line shape slot 715 is illustrated in the paper tape 710.

Figure 7C:
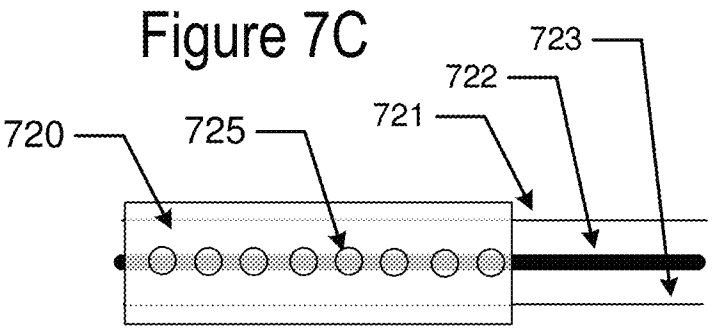

Referring now to FIG. 7C, an example is illustrated with a paper tape 720 and adhesive strips 721 and 723 surrounding the deposited adhesive 722. In this example, holes 725 are illustrated in the paper tape 720.

Figure 7D:
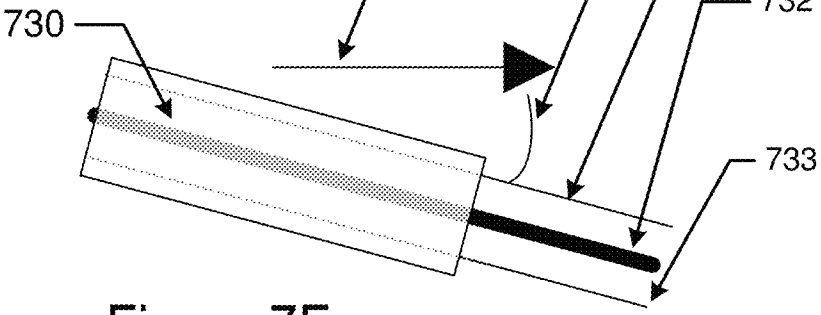

Referring now to FIG. 7D, an example is illustrated with a paper tape 730 and adhesive strips 731 and 733 surrounding the deposited adhesive 732. In this example, the paper and deposited adhesive bead construct may be installed upon the surface of the new spool at an angle 736 to the axis 735 of the new spool. In some examples, the resulting pattern may be described as a chevron pattern. In this type of installation, the paper tape and deposited adhesive construct will be pressurized at different locations as it rotates into the nip. Applying the adhesive bead and cover at an angle to the long axis of the spool map concentrate the nip pressure at the point of intersection between the adhesive system and the nip. This may increase the likelihood of the adhesive being expelled to capture the paper web. The application of the bead and cover at an angle to the long axis of the new spool may also limit the potential that the extra thickness of the adhesive bead across the width of the new spool may prevent certain regions from being pressurized.

Figure 7E:
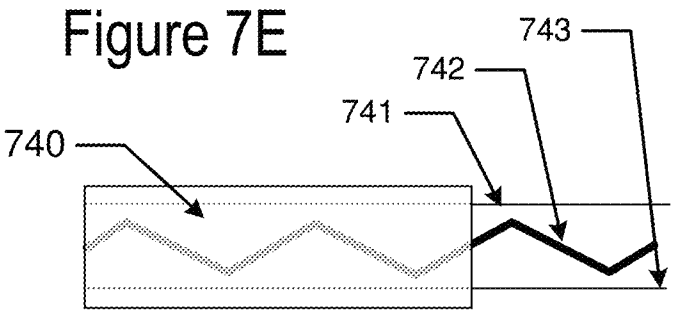
Figure 7F:
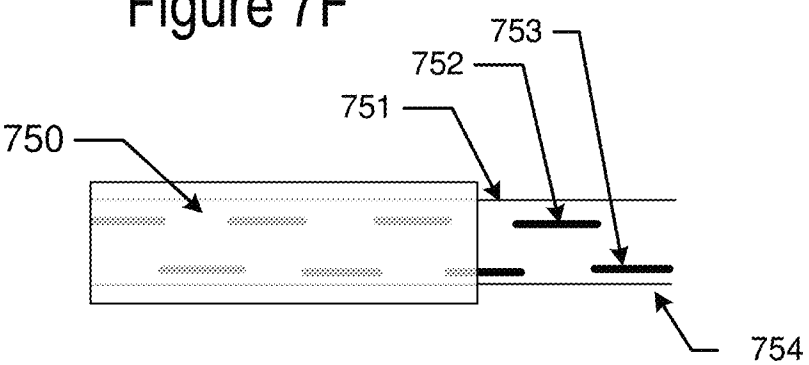

Referring now to FIG. 7E, an example is illustrated with a paper tape 740 and adhesive strips 741 and 743 surrounding the deposited adhesive 742. A non-linear pattern may be used to apply the adhesive. As illustrated an oscillation pattern may be deposited by the dispensing apparatus as the paper tape and adhesive structures are deposited. An oscillating pattern may have similar advantages as the example illustrated in FIG. 7D in that the new spool does not have to have its entire length sitting under pressure in the nip and therefore may have more uniform flow of adhesive across the full long axis, Referring now to FIG. 7F, an example is illustrated with a paper tape 750 and adhesive strips 751 and 754 surrounding the deposited adhesive strips 752, 753. An interrupted pattern may be used to apply the adhesive. As illustrated a two layer pattern or other interrupted pattern may be deposited by the dispensing apparatus as the paper tape and adhesive structures are deposited. An interrupted pattern may have similar advantages as the example illustrated in FIG. 7D or other patterns, may tailor the functionality of the adhesive bead with regard to saturation of the tissue cover, total effective surface area, dynamics of extrusion through perforations or cover bursting dynamics. Therefore, it may have more uniform flow of adhesive across the full long axis.

The selection of the system's components may be guided by a balance of characteristics each of which contributes to the function. For example, in some examples it may be desirable for the liquid adhesive to have a high enough viscosity to be easily controlled during application and not tend to migrate through the tissue over time or while the spool is spinning prior to the turn-up. The adhesive may also have an aggressive tack to capture the paper web instantly. The tissue paper for the paper cover may be strong enough to prevent tearing during application to the spool and to resist the centrifugal force of the adhesive bead. The pores in the paper may be small enough to prevent adhesive migration prior to the nip, but large enough to effectively disperse the adhesive in the nip.

Particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted the terms "comprising", "including", and "having" can be used interchangeably.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

As has been mentioned, the illustrations depict aspects of exemplary embodiments and the relative scale of illustrated features may be exaggerated for depiction of various aspects. Accordingly, the scale of features illustrated is not intended to limit the scope of the elements of the various embodiments consistent with the present application.

What is claimed is:

1. A paper web turn-up apparatus, the apparatus comprising:

a paper spool with a spool surface to attach a paper web;

a liquid adhesive bead dispenser positioned to deposit a liquid adhesive bead across the spool surface;

a paper cover formed separately and spaced apart from the paper web, the paper cover positioned to cover the deposited liquid adhesive bead, subsequently adhere to the advancing paper web, pull the advancing paper web to the paper spool, and sever the advancing paper web to complete a paper web turn-up; and wherein the deposited liquid adhesive bead flows to a surface of the paper cover when the deposited liquid adhesive bead rotates with the paper spool and comes upon and adheres to the paper web in between a nip of the paper spool and a reel drum.

2. The apparatus of claim 1 wherein the paper cover comprises tissue paper.

3. The apparatus of claim 1 wherein the paper cover is attached to the paper spool with a pressure sensitive adhesive.

4. The apparatus of claim 1 wherein the paper cover inherently comprises pores; and wherein the liquid adhesive bead flows through the pores when the liquid adhesive bead is pressurized within the nip.

5. The apparatus of claim 1, wherein the paper cover is punctured prior to its placement to give it perforations; and wherein the liquid adhesive bead flows through the perforations when the liquid adhesive bead is pressurized within the nip.

6. The apparatus of claim 1 wherein the paper cover comprises a paper with small perforations; and wherein the paper cover ruptures when the liquid adhesive bead is pressurized within the nip.

7. The apparatus of claim 1, wherein the liquid adhesive bead is deposited in a line.

8. The apparatus of claim 1, wherein the liquid adhesive bead is deposited at an angle relative to a rotary axis of the paper spool.

9. A method of performing a paper web turn-up, the method comprising:

depositing a liquid adhesive bead upon a spool surface of a paper spool;

coupling a paper cover comprising tissue paper formed separately and spaced apart from a paper web, to the spool surface of the paper spool;

covering the deposited liquid adhesive bead with the paper cover;

rotating the paper spool to press the liquid adhesive bead and the coupled paper cover between the paper spool and a reel drum in a nip of the paper spool and the reel drum;

flowing the liquid adhesive bead to a surface of the paper cover;

pressing the liquid adhesive bead and the coupled paper cover between the paper spool and the reel drum;

with the liquid adhesive bead upon the surface of the paper cover, adhering the advancing paper web to the paper spool; and severing the paper web to complete the paper web turn-up.

10. The method of claim 9 additionally comprising the step of preassembling the paper cover with pressure sensitive adhesive strips on an edge of the paper spool and release coating strips on an opposite edge of the paper spool.

11. The method of claim 9 wherein the paper cover is attached to the paper spool with a pressure sensitive adhesive.

12. The method of claim 9, wherein the paper cover inherently comprises pores, wherein the liquid adhesive bead flows through the pores when the liquid adhesive bead is pressurized within the nip.

13. The method of claim 9, wherein the paper cover is punctured prior to its placement to give it perforations; and wherein the liquid adhesive bead flows through the perforations when the liquid adhesive bead is pressurized within the nip.

14. The method of claim 9 wherein the paper cover comprises a paper with small perforations; and wherein the paper cover ruptures when the liquid adhesive bead is pressurized within the nip.

15. The method of claim 9, wherein the liquid adhesive bead is deposited in a line.

16. The method of claim 9, wherein the liquid adhesive bead is deposited at an angle relative to a rotary axis of the paper spool.

* * * * *